United States Patent [19]

Baumann

[11] Patent Number: 4,829,802

[45] Date of Patent: May 16, 1989

[54] METHOD AND APPARATUS FOR EXTRUDING OF METALS, ESPECIALLY LIGHT-WEIGHT METALS SUCH AS ALUMINUM

[75] Inventor: Hannes Baumann, Menziken, Switzerland

[73] Assignee: Aluminium AG Menziken, Menziken, Switzerland

[21] Appl. No.: 160,496

[22] Filed: Feb. 24, 1988

[30] Foreign Application Priority Data

Mar. 2, 1987 [CH] Switzerland ..... 784/87

[51] Int. Cl.[4] ..... B21C 29/02

[52] U.S. Cl. ..... 72/272

[58] Field of Search ..... 72/272, 271, 270, 253.1

[56] References Cited

U.S. PATENT DOCUMENTS

| | | | |
|---|---|---|---|
| 2,135,193 | 11/1938 | Moorhead . | |
| 3,042,195 | 7/1962 | Muller | 72/272 |
| 3,112,828 | 12/1963 | Zipf . | |
| 3,360,975 | 1/1968 | Edgecombe | 72/272 |
| 3,364,707 | 1/1968 | Foerster . | |
| 3,369,385 | 2/1968 | Murphy et al. | 72/272 |
| 4,462,234 | 7/1984 | Fiorentino et al. . | |

FOREIGN PATENT DOCUMENTS

| | | |
|---|---|---|
| 429376 | 5/1926 | Fed. Rep. of Germany . |
| 2211645 | 9/1972 | Fed. Rep. of Germany . |
| 2240391 | 3/1974 | Fed. Rep. of Germany . |

*Primary Examiner*—Lowell A. Larson

*Attorney, Agent, or Firm*—Frishauf, Holtz, Goodman & Woodward

[57] ABSTRACT

To increase the extrusion speed for extrusion of light-weight metal such as aluminum, without incurring hot short cracks, or fissures, and retaining high-quality smooth surface of the extruded material, the region of the extrusion chamber immediately ahead of the extrusion die (3) is cooled by placing a cooling ring (12, 12') between the bore (9) of the extrusion cylinder in which the ram piston (13) operates. The cooling ring may be a unitary structure, or a multi-part structure, in which an independent inner ring is located within a cooling ring (12). For mechanical strength, a prestressing outer ring (20) is shrink-fitted around the cooling ring. The outer ring is retained, for example by screws (24), on the cylinder (2) within which the extrusion chamber (9, 10) is located. The cooling fluid may be water, a vaporizable liquid, or a gas, and is separated from the billet (1) within the extrusion chamber.

24 Claims, 2 Drawing Sheets

METHOD AND APPARATUS FOR EXTRUDING OF METALS, ESPECIALLY LIGHT-WEIGHT METALS SUCH AS ALUMINUM

The present invention relates to a method to extrude light-weight metals such as aluminum or the like, to form extruded shapes, such as extruded profiled rails, strips or rods or the like; and to an apparatus, or extrusion press, and operating in accordance with the method.

BACKGROUND

Substantial forces are required for extrusion of metals to provide profiled metal shapes, for example profiled rails, which may be of light-weight metal. Various parameters are interrelated, such as the temperature of the ram piston, the temperature of the material, that is, of the billet to be extruded, pressure, degree of transformation during extrusion, extrusion press speed, surface condition, and metallurgical characteristics of the formed extrusion. The interrelationships of these parameters are quite complex, and change of any one parameter influences other parameters which, all, interact and interrelate. Upon deformation of the material of the slug or billet during extrusion, internal deformation and frictional heat will be generated in addition to that which is used to heat the slug or billet to extrusion temperature.

The temperature of the extrusion material, and the speed of extrusion, are critical particularly when extruding light-weight metal portions or shapes since heat fissures, referred to as hot short cracks, may occur. U.S. Pat. No. 4,462,234, Florentino et al, the disclosure of which is hereby incorporated by reference, contains a discussion of problems which arise during extrusion.

If the extruded material exceeds a certain critical temperature, it is difficult and sometimes impossible to obtain a perfect smooth surface of the extruded profiled structure. It appears that this is due to remanent eutectic components which become liquid during extrusion and then result in roughened zones at the surface of the extruded structure. To obtain a smooth surface, therefore, the extrusion speed in the past had been held to a range below that in which rough surface portions were observed and, thus, this problem limited the possible extrusion speed although the extrusion presses as a whole could operate at a higher speed. It was also tried to solve the problem of hot short cracking by cooling the die itself. Providing a die with cooling substantially increases the costs of the die. The intensity of cooling, itself, is limited since the die, upon being cooled, is exposed to the danger of formation of fissures.

It has previously been proposed to reduce the cross-sectional area of the billet as it is being extruded in steps and to cool the extruded material in intermediate steps. Such a system is expensive to apply, requires costly tools and dies, and is not practical for use with single-opening dies and extrusion presses.

Cooling the die itself has been proposed, and various such cooling systems are known. U.S. Pat. No. 3,112,828 discloses a single-opening extrusion press die which is interiorly cooled. It has a die opening in the center thereof which is surrounded by a cooling duct. Cooling is effected only in the die itself, that is, after the billet has been already essentially deformed to the shape it should have. The arrangement requires forming the requisite cooling ducts for the cooling system in each die. This substantially increases the cost of making the dies. Cooling the interior of the die limits the cross-sectional area which can be used and weakens the die which, of course, is highly stressed mechanically. Additional weakening is due to the temperature difference or temperature gradient within the interior of the die.

German Pat. No. 22 40 391 describes a solution similar to that of the U.S. Pat. No. 3,112,828, applied to a multiple-opening die. The cooling duct system is provided both in a pre-shaping die and in a final or finishing die. The system has the disadvantage that the cooling ducts must be formed by machining the die and cutting it into the die and, further, matching the shape and arrangement of the cooling ducts to the respective shapes of the profiles which are to be extruded. The die itself is weakened, and, due to the temperature gradient which results, becomes subject to cracking and formation of fissures. The cooling arrangement, primarily, was designed to control the exit speed of the respective individual shaped structural elements so that from one billet, rods or rails of essentially the same length can be obtained.

German Pat. No. 22 11 645 describes an arrangement in which the exit of the die is cooled at the exit surface. Such an arrangement is suitable primarily when using liquid nitrogen as the cooling medium. Liquid nitrogen will exit in gaseous form which can be directed on the extruded rail or rod. This arrangement, as well as the operation of the cooling system, depends on the shape of the rod to be extruded.

German Pat. No. 429,376 describes an arrangement in which a die extends into a housing defining an extrusion chamber, and the outside of the die is cooled at the portion external to the extrusion chamber.

U.S. Pat. No. 4,462,234, Florentino et al, describes a two-step die which is cooled in a region external of the extrusion chamber. Such a cooling arrangement is suitable, for all practical purposes, only for single-opening dies. The cooling arrangement must be matched to the shape of the die and is dependent thereon.

THE INVENTION

It is an object to increase the extrusion speed of extrusion apparatus while retaining all the advantages of excellent quality of structures extruded at low speed, that is, provide extruded structural shapes which are not subject to fissures or hot short cracking, and have a smooth surface of highest quality.

Briefly, a cooling system is provided to cool the slug or billet in the region immediately in advance of the die, for example by circulating a cooling fluid through the housing portion defining the extrusion chamber, located in advance—with respect to metal flow—of the die itself. The cooling fluid is not in contact with the billet itself, but, rather, is circulated in an independently positioned separated cooling circuit.

In accordance with a feature of the invention, the region of deformation of the billet, in advance of the extrusion die, is surrounded by an inner ring which has a bore of the same diameter as the ram piston, to form a coaxial extension of the chamber in which the ram piston operates. This ring is surrounded by a cooling ring structure which has cooling ducts drilled or bored therein, the ring itself being surrounded, for example by a shrink fit, with structural elements to provide the necessary strength to accept the extrusion forces. The cooling ring has a cooling medium circulating therein in a closed circuit. The cooling ring is seated directly on the inner ring.

The inner ring is not strictly necessary, and the cooling ring, itself, may be formed with an inner diameter which matches the outer diameter of the ram piston and which forms an axial extension of the billet-receiving chamber in which the ram piston operates as it extrudes the material of the billet through the die.

The reference to a closed cooling loop or circuit is intended to mean that the cooling fluid is separated from the billet, that is, is spatially separate therefrom; whether the cooling fluid itself is recirculated in a closed loop, or is merely circulated through the respective cooling ring in an open system, is not material to the present invention; what is important, however, is the separation of cooling fluid from the billet itself.

The method and apparatus of the invention are based on the fact that when the goods are to be extruded they must be changed from the original cross-sectional area of the billet to the much smaller cross-sectional area of the extruded profile. This deformation of the material results in substantial internal friction which results in additional heat, and this additional heat has substantial influence on the generation of hot short cracks and fissures. Consequently, that heat should be conducted away in the region of its generation, which is in the chamber receiving the billet and in the vicinity in advance of the die, and preferably just immediately in advance of the die and not only within the die itself or downstream of the die. It is more effective to cool the billet directly at the point in which the greatest deformation of material arises, which also results in the highest increase in temperature, rather than carrying out deformation in multiple steps in cooling in one or more of the subsequent steps, downstream of the first deformation.

The discovery of the particular location at which the material should be cooled does not, however, then also permit practical realization of a method or apparatus since problems result. By cooling, temperature gradients occur which, in the structures involved, may cause dangerous fissures and cracks. By forming a cooling ring which, preferably, is radially outwardly surrounded by a pressure ring capable of accepting the deformation forces, fissures and cracks can be essentially avoided since the tendency to form such fissures will be counteracted. The outside surrounding ring is, preferably, shrink-fitted over the cooling ring. It also permits the cooling system to be constructed in essentially symmetrical form, essentially surrounding the entire chamber just in advance of the place where the material to be extruded enters the die.

The cooling structure is an element independent of the die. Thus, even if the dies are to be changed, no additional cooling ducts or other changes are necessary, which substantially decreases the cost of the installation and the cost of dies, and permits utilization of the dies in different types of apparatus. The dies are highly stressed and are not additionally loaded by temperature jumps or steep temperature gradients since cooling methods and systems in accordance with the present invention do not affect the die itself. The same cooling system can be used for different shapes to be extruded, be they solid or hollow, and can be used with dies which have one or a plurality of die openings. They may be used, likewise, for extrusion of tubular structures either with a cooled or an uncooled mandrel.

The actual construction of the cooling system at the end of the chamber which receives the billet, and facing the die, permits carrying the cooling medium close to the billet itself at the zone where the billet material is deformed. Thus, a quickly acting and effective cooling of this deformation zone can be obtained. By carrying away frictional and deformation heat directly from the deformation zone, it is possible to extrude with higher temperatures of the billet being introduced into the deformation chamber, that is, with higher initial billet temperature.

DRAWINGS

DETAILED DESCRIPTION

Figure 1:
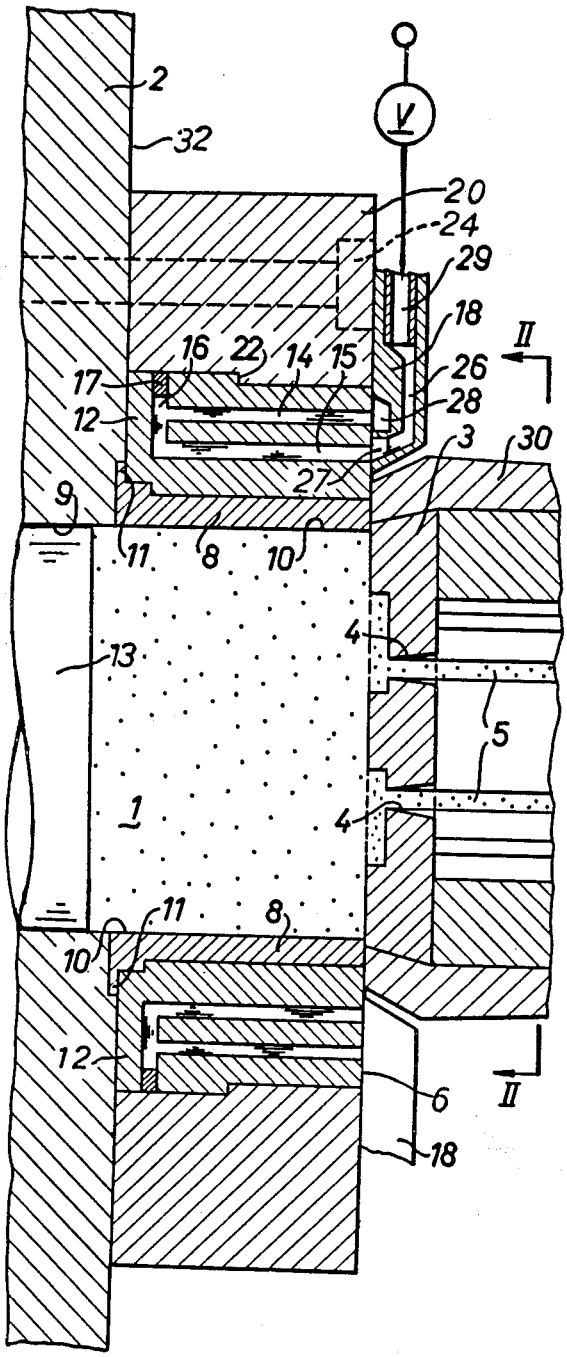
FIG. 1 is a longitudinal sectional view through an extrusion press in the region of an extrusion chamber and a die, and showing the deformation region, and the cooling arrangement.

The material to be extruded is placed, for example in the shape of a light-metal slug or billet 1, in a chamber formed in an extrusion cylinder 2, in which a ram piston 13 operates. The chamber is formed by a bore 9 in the extrusion cylinder 2. An extrusion die 3 is formed with one or more die openings 4, suitably shaped and corresponding to the cross-sectional or profiled form 5 of the extrusion products. The extrusion is carried out in a one-step process.

In accordance with the invention, a cooling system in form of a unitary one-element cooling ring, is located in the region where the billet 1 is deformed and kneaded, immediately in advance of the die 3. The cooling ring has a cooling medium circulating therein, separated or closed off from the billet 1. The cooling medium is circulated in a closed-off path; "closed off" is defined to mean that the cooling medium does not at any time contact the element to be cooled, namely the billet; rather, it is supplied to the cooling ring through a supply line and removed via a drain line. The cooling ring 12 is coaxially secured on an inner ring 8 which, also, is a unitary single element.

The inner ring 8 is formed with a cylindrical bore which has the same inner diameter as the bore 9 of the chamber receiving the billet, and is coaxial therewith. Thus, it corresponds to the diameter of the ram piston 13. The cooling ring 12 is formed with a plurality of axially extending pairs of bores or openings 14, 15, uniformly distributed around the circumference of the cooling ring 12.

In accordance with a feature of the invention, the spacing at the inner reference diameters of the bore pairs 14, 15 is between about 15 to 50 mm, depending on the diameter of the bore 9. The bores of the pair of bores 14, 15 are interconnected by radial bores 16, located in the interior of the cooling ring 12 and close to the end thereof remote from the die 3. The radial bores 16 are externally closed off by plugs 17. Thus, a closed circulating path is available for a cooling medium within the cooling ring 12, without contact of the cooling medium with the billet 1. At the end surface 6 of the cooling ring 12, that is, the surface facing the die 3, the bores of the pairs 14, 15 are, respectively, connected to a supply line and a drain line, located in a ring-shaped housing 18. The face end 6 of the cooling ring 12 has two concentric ring chambers 27, 28 attached thereto, of different diameters. One, each, is in fluid communication with the ends of the bores 14, which are radially outward; the other chamber is in fluid communication with the ends of the radially inward bores 15. Connecting nipples 29, of which only one is visible, are coupled to the respective chambers, for connection to suitable pipe or hose lines, and located within, or projecting from the housing 18. A controllable throttle valve V is preferably located in either the supply line or the drain line, preferably in the supply line. The valve V permits control of the fluid throughput and thus the cooling effect or cooling energy, so that it can be continuously matched to the deformation or extrusion requirements, and thereby keep the temperature of the billet 1 in the deformation zone at an optimum level. A temperature sensor, not shown, can be located either in or on the end face of the die 3, or in or on the sleeve 8, or in or on the cooling ring 12, to control the valve V.

Under some conditions, and particularly if the present invention is to be used with already existing extrusion presses, the preferred placement of the supply and drain system of the cooling medium at the end adjacent the die may not be possible, for example due to difficulties in placing or arranging the cooling system. For such installations, the supply and drain lines to supply and drain cooling medium can be placed at the side adjacent the press cylinder 2, by providing suitable radial bores communicating with the bores 14, 15 and leaving the ends of the bores 14, 15 solid at the side adjacent the die 3. The arrangement as shown, however, is preferred.

The cooling fluid may be any suitable fluid which is available, for example water or other liquids; vapors, gases, and vaporizable liquids may also be used.

The die 3 is secured with its end face against the cooling ring 12 and the inner ring 8. Connecting the die 3 and the ring 30 together with the extrusion press is effected in conventional and well known manner by fastening or fitting means not shown in the drawings. The axial length of the cooling ring 12 preferably is between 0.25 to 2 times the diameter of the ram piston 13 within the bore 9. The cooling effect thus occurs axially close to the die 3. The wall thickness of the ring 8 is preferably somewhat less than half the thickness of the cooling ring 12. To obtain fast reacting cooling, the wall thickness of the ring 8 is preferably less than one quarter the diameter of the bore 9 in which the ram piston 13 operates so that the cooling fluid is separated from the billet but radially close to the zone where deformation of the billet occurs.

The radially inner one of the cooling bores, that is, on the horizontal axis in FIG. 1, bores 15 are located circumferentially uniformly distributed around the ring 12, with diametrical spacing which is less than $1\frac{1}{2}$ that of the diameter of the cylinder bore 9, preferably less than $1\frac{1}{4}$ the diameter of the cylinder 9 within which the ram piston 13 operates.

Figure 3:
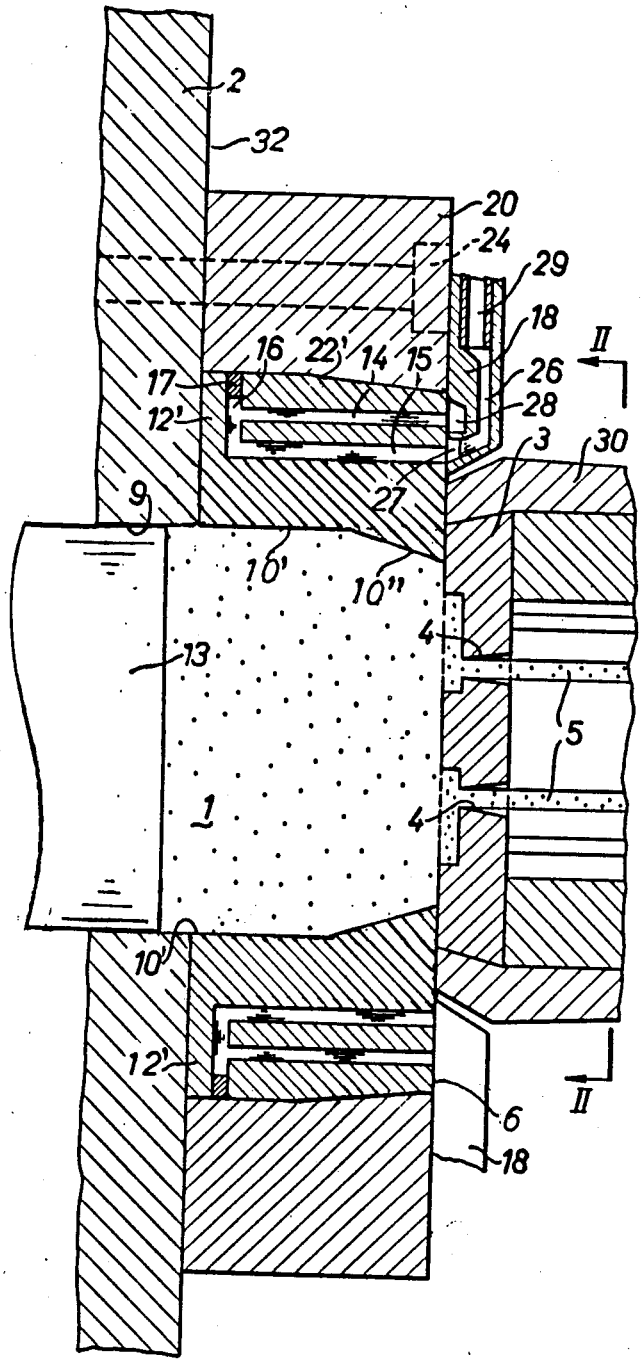
FIG. 3 is a view similar to FIG. 1 and illustrating another embodiment and modified features.

A radially outer pressure or force accepting ring 20 surrouns the cooling ring 12 at the outside thereof. It is secured to the facing surface 32 of the press cylinder 2 by bolts 24, of which only one is shown schematically. More than one such ring 20 may be used if strength to accept the extrusion pressure so requires. Preferably, then, such force accepting rings 20 are sequentially shrink-fitted about each other. The cooling ring 12, preferably, is also shrink-fitted on the inner ring 8. To permit transfer of axial forces, the inner ring 8 as well as the cooling ring 12 and the pressure ring 20 can be formed with suitable ring shoulders 11, 22. Rather than using ring shoulders, the interengaging elements can be conical in the region where the ring shoulders are shown, to fit against each other. The conical part can be extended over the whole length of part 12'. FIG. 3 shows conical surfaces 22'.

Figure 2:
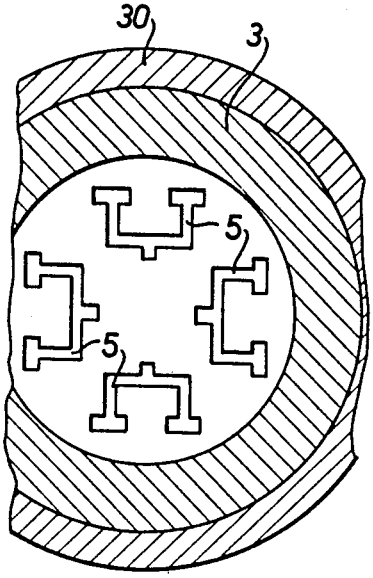
FIG. 2 is a fragmentary cross-sectional view through the die along the line II—II of FIG. 1.

The cooling ring 12 need not be fitted against an inner ring 8; as shown in FIG. 3, a cooling ring 12' may be used which, as a single element, replaces the cooling ring 12 as well as the inner ring 8, the cooling ring 12 having an inner bore 10', matching the bore 9 in which the ram piston 13 operates. At least one external force accepting ring 20 is shrink-fitted on the cooling ring 12'. In all other respects, the arrangement is similar to that described in connection with FIGS. 1 and 2, and the same reference numerals have been used to identify identical parts.

The inner ring 8 and/or cooling ring 12, 12' need not have an inner cylindrical shape but, rather, may be somewhat conical, at 11'', to direct the billet material 1 to the openings 4 in the die 3. The inlet or input end of the bore 10, 10', however, should match the bore 2 in the extrusion cylinder 2.

The deformation and frictional heat is removed directly from that zone where the deformation of the material of the billet arises, that is, immediately in advance of the die 3. The heat is removed, thus, from just that region adjacent the die 3 in order to retain the temperature of the material to be extruded, that is, the billet 1, at an optimum level. It has been found that cooling the billet results in substantially increased output, with increased extrusion speed, without degradation of strength or surface characteristics.

The following table illustrates comparison results. The light-metal alloys are defined by their ASTM (American Society for Testing Materials, Philadelphia, PA) numbers; additional standards of the alloys shown have been published by the Aluminum Association, Washington, D.C. 20006.

Various changes and modifications may be made, and features described in connection with any one of the embodiments may be made with any of the others, within the scope of the inventive concept. For example, the conical engagement surface 22' shown in FIG. 3 may be used at any one of the steps 11, 22 in FIG. 1. The die 3 can be surrounded by a die holding ring 30, to accept mechanical stresses, as well known.

TABLE

| | Light-metal alloys ASTM | Billet temperature °C. | Extrusion speed (average value) |
|---|---|---|---|
| Profiles | | | |
| without cooling ring | 2014 | 440 | 0.8 m/min. |
| with cooling ring | 2014 | 500 | 2.2 m/min. |
| without cooling ring | 2024 | 420 | 1.2 m/min. |
| with cooling ring | 2024 | 440 | 3.0 m/min. |
| without cooling ring | 7075 | 440 | 0.8 m/min. |
| with cooling ring | 7075 | 470 | 2.1 m/min. |
| Tubular structure | | | |
| without cooling ring | 7075 | 440 | 0.6 m/min. |
| with cooling ring | 7075 | 445 | 3.7 m/min. |

I claim:

1. The combination of apparatus for extrusion of a metal billet (1), particularly hot short crack sensitive metal such as aluminum and other light-weight metals, while maintaining a smooth surface finish, having an extrusion cylinder (2) defining an extrusion chamber (9) formed as a bore in a housing;

a ram piston (13) operable, at least in part, in said extrusion chamber;

an extrusion die (3) positioned to receive extruded material of said billet, with means for cooling the billet in the region where the metal of the billet is subject to greatest deformation, said cooling means comprising a cooling ring (12, 12') located immediately in advance—in the direction of extrusion—of the die (3), the cooling ring having an inner bore which matches the bore (9) of the extrusion cylinder and forms a coaxial extension of said bore at the side of the die, the axial length of said cooling ring (12, 12') being less than twice the diameter of the bore;

means (14, 15, 18, 26, 27, 28, 29) for circulating a cooling fluid in said cooling ring, while separating and isolating said cooling fluid from said billet, being closed off therefrom, and located in the region in which the major extent of deformation of the billet, as it is being extruded, occurs, said fluid circulating means being uniformly distributed about the chamber at a minimum diameter which is less than 1.5 times the diameter of the ram piston (13); and a stress accepting ring means (20) tightly surrounding said cooling ring (12, 12'), said stress-accepting ring means being secured to said extrusion cylinder.

2. The combination of claim 1, wherein said cooling means comprises a two-part structure including an inner ring (8) having a bore (10) forming a coaxial extension of the bore (9) in the extrusion cylinder (2) of the same diameter as said bore; and a cooling ring element (12) snugly surrounding said inner ring (8) and having said cooling medium circulating therein.

3. The combination of claim 2, wherein said inner ring (8) and said cooling ring (12, 12') are axially interfitted and include interengaging radially divergent surface regions (22, 22').

4. The combination of claim 1, wherein said fluid circulation means comprises a plurality of axially extending bores (14, 15) formed in said cooling ring (12, 12'), extending within the material of said ring;

and supply and drain connection means (26, 27, 28, 29) coupled to respective ones of said axially extending bores to supply and drain a cooling fluid to and from said bores.

5. The combination of claim 4, wherein said bores extend from an end face (6) of said ring and terminate short of another end face, two bores, each, being in radial alignment;

a cross bore (16) connecting said radially aligned bores; and plug means (17) closing off said cross bores at radially outer ends thereof.

6. The combination of claim 1, wherein said cooling fluid circulating means comprises a plurality of paired radially spaced axially extending interconnected ducts (14, 15), uniformly circumferentially located within said cooling ring (12, 12');

and wherein the radially inner one (15) of the duct of the duct pairs is located on a diameter which is less than 1.5 times the diameter of the ram piston (13).

7. The combination of claim 1, wherein the cooling ring (12, 12') and said stress accepting ring element (20) are axially interfitted and include interengaging radially divergent surface regions (22, 22').

8. The combination of claim 1, wherein said cooling fluid circulation means include paired radially spaced axial bores (14, 15) formed in said cooling ring (12, 12');

and connection duct means (27, 28) in fluid communication with said axial bores, and located at the side of the cooling ring adjacent the die (3).

9. The combination of claim 1, wherein said means for circulating the cooling fluid includes a controllable throttle valve (V) for control of the throughput of cooling fluid.

10. The combination of claim 1, wherein the chamber receiving the billet, in the vicinity of the die (3) converges conically.

11. The combination of claim 1, wherein said cooling ring (12') is a single element having a cylindrical bore (10) forming a coaxial extension of the bore (9) defining said chamber in the extrusion cylinder (2), both said bores having the same diameter; and wherein said fluid circulation means comprises radially spaced, axially extending ducts (14, 15) formed in said single element for circulation of said cooling medium therein.

12. The combination of claim 1, wherein said stress-accepting ring means (20) is shrink-fitted on said cooling ring (12, 12').

13. A cooling device for use in an apparatus for extrusion of a metal billet (1), particularly hot short crack sensitive metal such as aluminum and other light-weight metals, while maintaining a smooth surface finish, in which the apparatus has an extrusion cylinder (2) defining a cylindrical extrusion chamber (9);

a ram piston (13) operable, at least in part, in said extrusion chamber; and an extrusion die (3) positioned to receive extruded material of said billet, said cooling device comprising, in accordance with the invention, a cooling ring (12, 12') located immediately in advance—in the direction of extrusion—of the die (3) so that the cooling is located in the region in which the major extent of deformation of the billet, as it is being extruded, occurs, the cooling ring having an inner bore (10) which matches a bore (9) of the extrusion cylinder and forms a coaxial extension with the same diameter of said bore at the side of the die; and having an axial length which is less than twice the diameter of the bore;

fluid circulation means (14, 15, 18, 26, 27, 28, 29,) for circulating a cooling fluid formed in said cooling ring, while separating and isolating said cooling fluid from said billet (1) and closed off therefrom, comprising a plurality of paired radially spaced, axially extending ducts (14, 15), uniformly circumferentially located within said cooling ring (12, 12'), and fluid supply and drain connection means (26–29) located at the side of the cooling ring which is adjacent the die (3) to supply and drain cooling fluid to and from said ducts; and a stress accepting ring means (20) tightly surrounding said cooling ring, said stress-accepting ring means being secured to said extrusion cylinder.

14. The device of claim 13, wherein said billet deformation region cooling means comprises a two-part structure including an inner ring (8) having a bore (10) forming a coaxial extension of the bore (9) in the extrusion cylinder (2); and a cooling ring element (12) snugly surrounding said inner ring (4) and having said cooling medium circulating therein.

15. The device of claim 13, wherein the radially inner one (15) of the duct of the duct pairs is located on a diameter which is less than 1.5 times the diameter of the ram piston (13).

16. The device of claim 13, wherein said cooling fluid supply and drain connection means includes concentric ring ducts (27, 28) in fluid communication with said axial ducts (14, 15), and located at the side of the cooling ring (12, 12') adjacent the die (3).

17. The device of claim 13, wherein said means for circulating the cooling fluid includes a controllable throttle valve (V) for control of the throughput of cooling fluid.

18. The device of claim 13, wherein said cooling ring (12) is a single element having a bore (10) forming a coaxial extension, and having the same diameter, said ducts (14, 15) being circumferentially located about said bore (10) formed in said element.

19. The device of claim 13, wherein said stress-accepting ring means (20) is shrink-fitted on said cooling ring (12, 12').

20. A method of extruding light-weight metals through a die, particularly hot short crack sensitive metals such as aluminum, while maintaining a smooth surface finish, at a high extrusion speed, comprising the steps of placing a billet of the metal in an extrusion chamber (9), said chamber being formed as a bore in an extrusion housing (2, 8, 12, 12');

producing pressure on the billet by a ram piston (13) to press the metal from the chamber through the die; and comprising, in accordance with the invention, the step of cooling the metal in the zone where, upon extrusion of the billet from the chamber through the die, the greatest deformation of the material of the billet arises, by cooling the metal only in a region of the chamber immediately in advance—with respect to the direction of extrusion—of the location of the die, said cooling step including circulating a cooling fluid through the housing defining said chamber (9) in a circumferentially uniformly distributed manner, separated from contact with said metal, and axially closely adjacent to said zone and said die (3) and radially closely adjacent to said zone to obtain fast reacting cooling at a location immediately in advance of the die and where the metal of the billet is subject to greatest deformation.

21. The method of claim 20, wherein the axial extent of said axial cooling region is less than twice the diameter of the chamber, and the cooling fluid is circulated in a space in the housing radially located with respect to said bore (9) and having a diameter of less than 1.5 times the diameter of the ram piston (13).

22. A cooling device for use in an apparatus for extrusion of a metal billet (1), particularly hot short crack sensitive metal such as aluminum and other light-weight metals, while maintaining a smooth surface finish, in which the apparatus has an extrusion cylinder (2) defining a cylindrical extrusion chamber (9);

a ram piston (13) operable, at least in part, in said extrusion chamber; and an extrusion die (3) positioned to receive extruded material of said billet, said cooling device comprising, in accordance with the invention, a cooling ring structure (12, 12') located immediately in advance—in the direction of extrusion—of the die (3), so that the cooling ring is located in the region in which the major extent of deformation of the billet, as it is being extruded, occurs, the cooling ring having an inner bore (10) which matches a bore (9) of the extrusion cylinder and forms a coaxial extension with the same diameter of said bore at the side of the die, and having an axial length which is less than twice the diameter of the bore;

fluid circulation means (14, 15, 18, 26, 27, 28, 29) for circulating a cooling fluid formed in said cooling ring, while separating and isolating said cooling fluid from said billet (1) and closed off therefrom, comprising a plurality of paired radially spaced, axially extending ducts (14, 15), uniformly circumferentially located about said inner bore (10) and extending within said cooling ring structure (12, 12'), and supply and drain connection means (26–29) located at the side of the cooling ring structure adjacent the die (3) to supply and drain the cooling fluid to and from said ducts (14, 15), said ducts being spaced from the wall defining said inner bore (10) by a ring zone having a thickness which is less than half the thickness of the cooling ring structure, and further which is less than one-quarter the diameter of said inner bore (10); and a stress-accepting ring means (20) tightly surrounding said cooling ring, said stress-accepting ring means being secured to said extrusion cylinder (2).

23. The device of claim 22, wherein said cooling ring structure is a unitary element, and said ring zone defines a region in said element.

24. The device of claim 22, wherein said cooling ring structure is a two-part element comprising an inner ring (8) having said inner bore (10) and forming a coaxial extension of the cylindrical extrusion chamber (9) in the extrusion cylinder (2);

and a cooling ring element (12) surrounding said inner ring (8), said ducts (14, 15) being formed in said cooling ring element.

* * * * *